United States Patent [19]

Jones

[11] 4,074,403

[45] Feb. 21, 1978

[54] TENNIS BALL NAPPER

[76] Inventor: Clifton Martin Jones, 844 10th St., Santa Monica, Calif. 90403

[21] Appl. No.: 753,439

[22] Filed: Dec. 22, 1976

[51] Int. Cl.[2] ..... D06C 11/00

[52] U.S. Cl. ..... 26/29 R; 26/37; 15/21 A

[58] Field of Search ..... 26/29 R, 31, 32, 37; 15/21 A

[56] References Cited

U.S. PATENT DOCUMENTS

| | | | |
|---|---|---|---|
| 1,766,198 | 6/1930 | Smilie | 26/29 R |

FOREIGN PATENT DOCUMENTS

| | | | |
|---|---|---|---|
| 666,428 | 10/1938 | Germany | 26/29 R |
| 667,110 | 11/1938 | Germany | 26/29 R |
| 20,257 of | 1907 | United Kingdom | 15/21 R |

*Primary Examiner*—Robert R. Mackey

*Attorney, Agent, or Firm*—Ralph B. Pastoriza

[57] ABSTRACT

An open frame structure has spring fingers for lightly gripping a tennis ball. A shaft rotatably mounts a napping wheel in the open frame structure, the periphery of the napping wheel having bristles except for a given circumferential section. Also secured to the shaft is a radially extending arm terminating in a friction pad to one side of the napping wheel and positioned to engage the tennis ball when gripped in the spring fingers. The arrangement is such that rotation of the napping wheel causes the bristles to successively engage the tennis ball to rotate the same about an axis parallel to the axis of the napping wheel shaft. Once each rotation, the friction pad on the radially extending arm will engage a side portion of the tennis ball and rotate it slightly about a different axis so that the bristles will engage a different circumferential path portion about the ball resulting in substantially the entire area of the ball being napped after several rotations.

7 Claims, 5 Drawing Figures

TENNIS BALL NAPPER

This invention relates to napping apparatus and more particularly a napping apparatus for napping tennis balls.

BACKGROUND OF THE INVENTION

The effectiveness of topspins, slices, and the like executed by expert tennis players in matches depends, to a large extent, on the amount of nap on the tennis ball. There is no problem with new tennis balls since a proper nap is initially provided. However, even after a few games of hard tennis with new tennis balls, some of the nap wears off on the surface of the tennis ball, thereby affecting its path through the air, its friction when bouncing from the court surface, and its aerodynamic characteristics when sliced or provided with a top or under spin.

Since the useful life of tennis balls generally exceeds the time for the nap to become ineffective, it has long been the practice to renap the ball by simply combing the surface with a bristle type brush. This operation is somewhat time consuming particularly if all surfaces of each tennis ball are to be properly renapped.

BRIEF DESCRIPTION OF THE PRESENT INVENTION

With the foregoing in mind, the present invention contemplates the provision of a very simple tennis ball napper in the form of an open frame structure having spring finger means for receiving a tennis ball. A shaft is rotatably mounted in the frame structure and carries a napping wheel having radially extending bristles about its periphery with the exception of a given circumferential section. The arrangement is such that rotation of the napping wheel will cause the bristles to engage the tennis ball and rotate the ball itself within the spring fingers about an axis parallel to the axis of rotation of the napping wheel.

In order that all surfaces of the tennis ball are properly napped, a radially extending arm is provided on the shaft to one side of the napping wheel terminating in a friction pad. For each complete rotation of the napping wheel, the friction pad will engage momentarily a side portion of the tennis ball and cause a slight rotation of the ball about an axis different from its normal axis of rotation caused by the bristles of the napping wheel. In this respect, the given smooth circumferential section of the napping wheel is radially aligned with the friction pad so that it is positioned under the ball at the time the friction pad engages the ball thereby permitting easy turning of the ball about the referred to different axis.

After several turns of the napping wheel, substantially the entire surface of the tennis ball is automatically napped.

Several such structures may be ganged together with a common shaft so that a plurality of tennis balls may be simultaneously napped.

In an alternative arrangement, a single large diameter napping wheel may be provided with spring finger grips circumferentially positioned about the napping wheel for holding a plurality of balls and permitting simultaneous napping.

BRIEF DESCRIPTION OF THE DRAWINGS

A better understanding of this invention will be had by referring to the accompanying drawings in which.

DETAILED DESCRIPTION OF THE INVENTION

Figure 1:
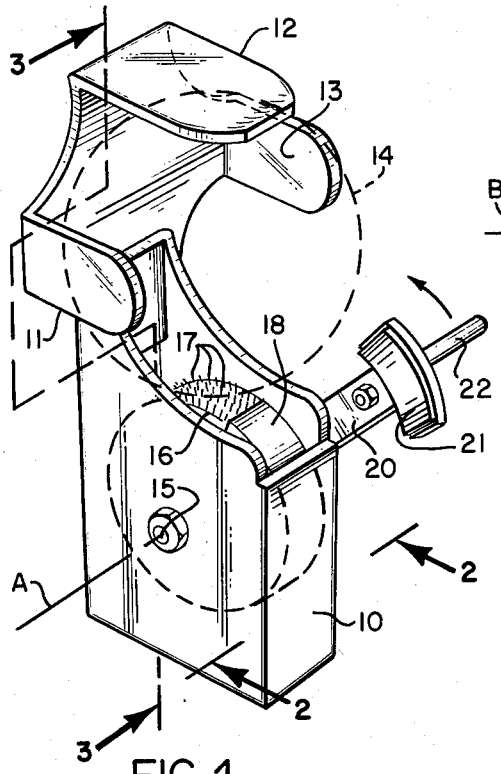
FIG. 1 is a perspective view of a basic embodiment of the tennis ball napper of this invention.
Figure 2:
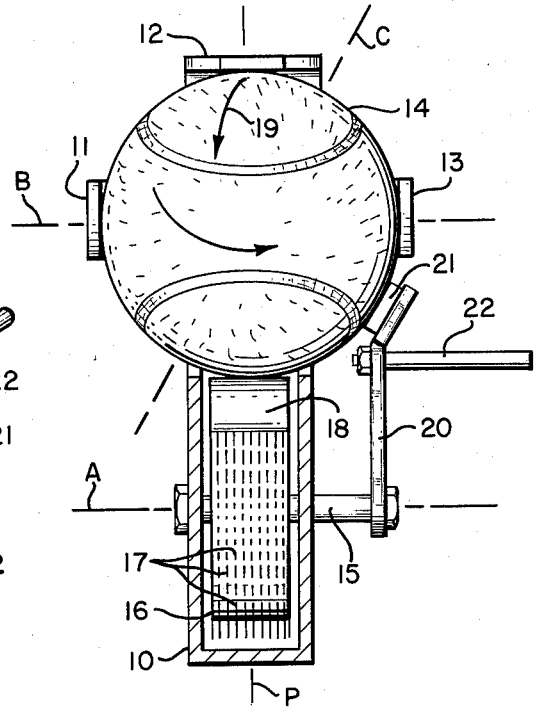
FIG. 2 is a front view partly in cross section looking in the direction of the arrows 2—2 of FIG. 1.

Referring to both FIGS. 1 and 2, the tennis ball napper includes an open frame structure 10 having spring fingers 11, 12 and 13 for lightly gripping a tennis ball 14. In FIG. 1 the tennis ball is shown in phantom lines to avoid obscuring other portions of the drawing while in FIG. 2, the tennis ball 14 is shown in solid lines.

A shaft 15 is rotatably mounted in the frame structure 10 and carries a napping wheel 16 for rotation by the shaft in a plane including the center of the tennis ball. This plane is normal to the plane of FIG. 2 and indicated by the letter P.

As shown in both FIGS. 1 and 2, the periphery of the napping wheel 16 includes radially extending bristles 17, except for a given smooth circumferential section 18. The positioning is such that the bristles successively engage the nap on the tennis ball 14 when the napping wheel 16 is rotated to thereby cause the ball to rotate in the spring fingers about an axis B parallel to the axis of rotation A of the napping wheel. The axes A and B are clearly illustrated in FIG. 2 and the rotation of the tennis ball 14 about the axis B is indicated by the arrow 19.

The assembly is completed by the provision of an arm 20 secured to and radially extending from the shaft 15 to one side of the napping wheel and terminating in a friction pad 21 positioned to engage a side portion of the tennis ball 14 each time the given smooth circumferential section 18 of the napping wheel engages the ball. Thus, in the position of the parts illustrated in FIG. 2 wherein the given smooth circumferential portion 18 of the napping wheel 16 is under the ball 14, the friction pad 21 on the arm 20 momentarily engages the side of the ball 14 to thereby turn the ball slightly about an axis C different from its axis B of rotation when engaged by the bristles 17 of the napping wheel.

This slight turning about the axis C as a consequence of periodic engagement of the friction pad 21 when the shaft 15 and napping wheel 16 are rotated assures that substantially the entire surface area of the tennis ball is automatically successively engaged by the bristles after several rotations of the napping wheel.

In the particular embodiment illustrated in FIGS. 1 and 2, there is provided a handle 22 projecting outwardly in a direction parallel to the axis A of the shaft 15 to enable simple manual rotation of the shaft and napping wheel.

Figure 3:
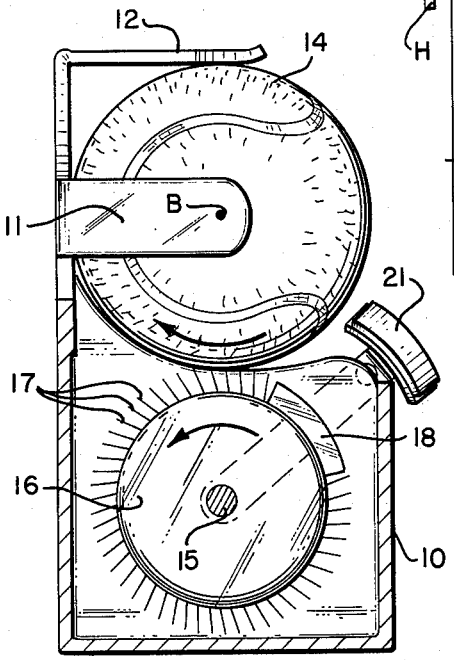
FIG. 3 is a side view partly in cross section taken along the section line 3—3 of FIG. 1.

The side view of FIG. 3 partly in section illustrates clearly the foregoing described action, it being noted that the smooth circumferential section 18 of the napping wheel 16 will be positioned beneath the ball 14 simultaneously with engagement of the side of the ball by the friction pad 21 thereby permitting easy slight turning of the ball 14 about the axis C as described in FIG. 2.

It will thus be appreciated that different circumferential paths about the spherical surface of the tennis ball 14 will be engaged by the bristles 17 of the napping wheel after several rotations thereof.

Figure 4:
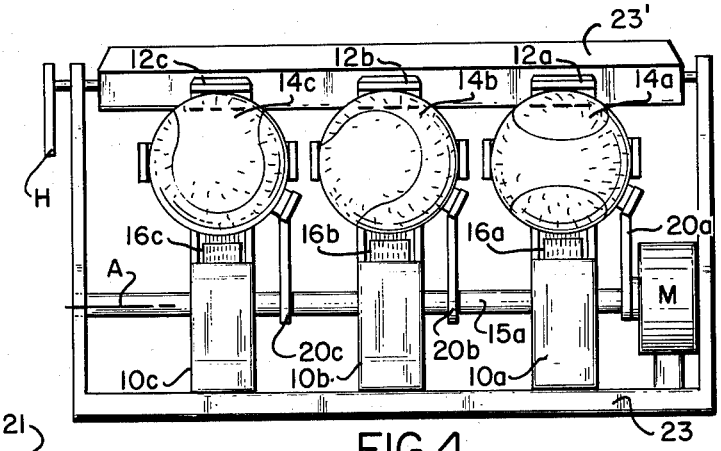
FIG. 4 is a full front view of a plurality of the structures of FIG. 1 ganged together to enable three tennis balls to be simultaneously napped; and, FIG. 5 is a side view partly in cross section of a further modification enabling simultaneous napping of three tennis balls.

FIG. 4 illustrates a tennis ball napper for napping three tennis balls simultaneously. Thus, there is provided a frame structure 10*a*, spring fingers, one of which is indicated at 12*a*, a napping wheel 16*a* and radially extending arm 20*a* all corresponding to the corresponding components described in the embodiment of FIGS. 1 through 3. Two additional frame structures 10*b* and 10*c* similarly have spring fingers such as indicated at 12*b* and 12*c* and napping wheels designated 16*b* and 16*c* positioned in side-by-side relationship with the frame structure 10*a* such that all of the napping wheels are in coaxial alignment. A single shaft 15*a* is then provided extending through the centers and then secured to all of the napping wheels, the shaft carrying additional radially extending arms 20*b* and 20*c* terminating in appropriate friction paths.

A single support 23 is provided for the frames 10*a*, 10*b*, and 10*c* and further serves to pivotably support a bar 23′ from which the top spring fingers are cantilivered to press down on the tennis balls. This bar can be rotated slightly by a handle H to adjust the resilient pressure simultaneously exerted on the balls and thereby control the degree of napping. A motor M may be used to drive the shaft 15*a* rather than the crank if desired.

With the above-described arrangement, three tennis balls indicated at 14*a*, 14*b* and 14*c* can be simultaneously napped.

Figure 5:
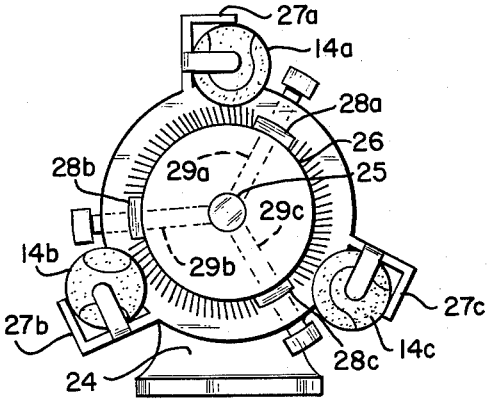

FIG. 5 shows a different structural arrangement for enabling the simultaneous napping of three tennis balls. In the structure of FIG. 5, there is provided a large open frame structure 24 rotatably supporting a shaft 25 in turn carrying a relatively large diameter napping wheel 26. Appropriate spring fingers such as indicated at 27*a*, 27*b* and 27*c* extend from the frame 24 at circumferentially spaced points relative to the napping wheel 26 for holding additional tennis balls, the balls again being indicated at 14*a*, 14*b* and 14*c*.

The napping wheel itself of FIG. 5 includes three smooth circumferential sections 28*a*, 28*b* and 28*c* while the shaft 25 carries three radially extending arms 29*a*, 29*b* and 29*c* terminating in friction pads. The arms extend in radial directions to be correspondingly circumferentially positioned with the smooth circumferential sections so that the friction pads at the ends of the arms will rotate the three tennis balls when the smooth sections fall beneath the respective balls upon rotation of the napping wheel 26.

Thus, in the structure of FIG. 5, three tennis balls can be simultaneously napped by a single large diameter napping wheel as described.

The particular napping operation for each individual ball in the embodiments of FIGS. 4 and 5 is identical to that described with respect to FIGS. 1 to 3.

It will be appreciated from all of the foregoing that tennis ball nappers as described may be provided at municipal tennis courts and can even be associated with coin operated equipment so that tennis players can periodically nap their tennis balls.

It will thus be evident that the present invention has provided a substantial improvement in apparatus for napping tennis balls all to the end that napping operations can be carried out far more rapidly than has been possible by the known systems of napping.

I claim:

1. A tennis ball napper including, in combination:

(a) an open frame structure having spring finger means for lightly gripping a tennis ball;

(b) a napping wheel;

(c) a shaft to which said napping wheel is secured, mounted in the frame for rotating said napping wheel in a plane including the center of said tennis ball, the periphery of said napping wheel including radially extending bristles successively engaging the nap on said ball when said napping wheel is rotated to thereby cause said ball to rotate in said spring finger means about an axis parallel to the axis of rotation of said napping wheel; and (d) means mounted directly to the shaft for rotating with said shaft and extending adjacent to one side of said napping wheel and including a friction pad positioned for periodically engaging a side portion of said tennis ball to thereby turn the ball slightly about an axis different from its axis of rotation when engaged by said bristles, whereby substantially the entire surface area of said tennis ball is automatically successively engaged by said bristles after several rotations of said napping wheel.

2. A tennis ball napper according to claim 1, including two additional frame structures having spring finger means and napping wheels similar to said first mentioned frame structure, spring finger means and napping wheel, said additional frame structures being positioned in side-by-side relationship with said first mentioned frame structure so that all the napping wheels are coaxial, said shaft extending through the centers of the additional napping wheels and being secured thereto and including additional means mounted for rotation with said shaft and including additional friction pads so that all the napping wheels can be rotated simultaneously to thereby enable three tennis balls to be napped simultaneously.

3. A tennis ball napper according to claim 2, in which said spring finger means includes three fingers in the form of flexible strips biased downwardly against the tops of the three tennis balls; and a single bar from which said spring fingers are cantilevered, said bar being pivotally mounted to the open frames for rotation about an axis parallel to the axis of rotation of the napping wheels; and, handle means for rotating the bar through a slight angle to vary the downward pressure of the spring fingers exerted on the three balls simultaneously so that the degree of napping can be controlled.

4. A tennis ball napper according to claim 3, including a motor connected to said shaft for rotating said shaft.

5. A tennis ball napper according to claim 1, in which said open frame structure includes additional spring finger means positioned at circumferentially spaced points relative to said napping wheel for holding additional tennis balls for engagement by said bristles upon rotation of said napping wheel, and additional means mounted for rotation with said shaft and including friction pads at circumferentially spaced points for engaging said additional tennis balls periodically upon rotation of said napping wheel whereby a plurality of tennis balls may be simultaneously napped.

6. A tennis ball napper according to claim 1, in which the periphery of said napping wheel includes a given smooth circumferential section free of bristles, said friction pad engaging the side of said tennis ball when said smooth circumferential section engages said tennis ball upon rotation of said napping wheel to facilitate turning of the ball about said different axis.

7. A tennis ball napper according to claim 1, in which said means mounted for rotation with said shaft comprises a radially extending arm secured to said shaft; and a crank on said arm to facilitate manual rotation of said napping wheel.

* * * * *